US006170491B1

(12) United States Patent
Maekawa

(10) Patent No.: US 6,170,491 B1
(45) Date of Patent: Jan. 9, 2001

(54) ELEMENT AND METHOD FOR FIXING A WIG TO A HEAD OF A WEARER

(75) Inventor: Noriyuki Maekawa, Niigata-ken (JP)

(73) Assignee: Aderans Co., Ltd., Tokyo (JP)

( * ) Notice: Under 35 U.S.C. 154(b), the term of this patent shall be extended for 0 days.

(21) Appl. No.: 09/214,849

(22) PCT Filed: May 13, 1998

(86) PCT No.: PCT/JP98/02115

§ 371 Date: Jan. 14, 1999

§ 102(e) Date: Jan. 14, 1999

(87) PCT Pub. No.: WO98/51173

PCT Pub. Date: Nov. 19, 1998

(30) Foreign Application Priority Data

May 14, 1997 (JP) ..... 9-137963

(51) Int. Cl.[7] ..... A41G 5/00
(52) U.S. Cl. ..... 132/201; 132/54
(58) Field of Search ..... 132/201, 53, 54, 132/55, 56, 200

(56) References Cited

U.S. PATENT DOCUMENTS

| | | | | |
|---|---|---|---|---|
| 851,384 | * | 4/1907 | Sleicher | 132/53 |
| 2,736,325 | * | 2/1956 | Dvorzsak | 132/201 |
| 3,710,452 | * | 1/1973 | Hamrick | 132/53 |
| 3,716,065 | * | 2/1973 | Finamore | 132/53 |
| 5,592,957 | * | 1/1997 | Gazerro et al. | 132/53 |
| 5,853,009 | * | 12/1998 | Yu | 132/201 |

* cited by examiner

*Primary Examiner*—Pedro Philogene
(74) *Attorney, Agent, or Firm*—Wenderoth, Lind & Ponack, L.L.P.

(57) ABSTRACT

A wig-fitting component is not bulky at an area of attachment to the natural hair, provides a natural feeling during the wear thereof over a long period of time, is capable of being fixed securely over a long period of time, and is free from adverse influence on the hair skin and roots of the hair. The wig-fitting component is capable of being fixed without causing any damage, deformation and discoloration of a wig base. The wig-fitting component includes a net-type component struck on one side of a flexible planar component, with adhesive being adhered to opposite surfaces of the planar component.

9 Claims, 6 Drawing Sheets

ELEMENT AND METHOD FOR FIXING A WIG TO A HEAD OF A WEARER

FIELD OF THE INVENTION

The present invention relates to a wig-fitting component for use in fixing a wig to the head of a wearer or user, a method of fixing the wig-fitting component to a wig base, and a method of fixing a wig to the head of the wearer.

DESCRIPTION OF THE PRIOR ART

Conventionally, the following techniques have been employed as methods of fixing a wig to the head of a wearer.

Conventional method (1): fitting a wig by holding the natural hair (the hair of a wig-wearing user) by a hair pin or a wig stopper with the teeth of a comb.

Conventional method (2): fixing a wig by sticking a double-sided tape with an adhesive adhered thereto to a rim part of the back of a wig base and fixing the wig to the natural hair or directly to the head skin by adhesion thereof.

Conventional method (3): Fixing a wig by applying a hair adhesive onto the rim part of the back of a wig base and fixing the wig to the natural hair.

However, all of the above methods have problems. That is, with the method of fixing a wig to the natural hair by a hair pin and the like (the above method (1)), the wig can be put on and taken off easily, but since a hair pin and a stopper have some thickness, bulkiness occurs at the wig-fitting area, and a sense of incongruity has been felt at times during the wear thereof over a long period of time. With the method of fixing a wig to the natural hair employing a double-sided tape (the above method (2)), the wig can be put on and taken off easily and no bulkiness at the wig-fitting area occurs. However, adhesion is poor, the wig can be released by sweat and fat from the hair skin, and it has been difficult to wear over a long period of time. In addition, since the adhesion of an adhesive onto the back of a wig base is not very strong with this method, the wig may be become released from the wig base at times. Moreover, in the method of applying an adhesive (the above method (3)), the applied adhesive is pressed onto the wig and thereby spreads in a wider range than necessary, which may have an adverse influence on the head skin and roots of the hair. In addition, the adhesive may cause deformation and discoloration of the wig base. Also, when the wig is fitted again, previously solidified adhesive matter adhered thereto must be released and removed from the wig base, and at this time the wig base may be damaged.

SUMMARY OF THE INVENTION

The present invention has been accomplished for the purpose of avoiding various problems in the above conventional methods of fixing a wig.

One object of the invention is to provide a wig-fitting component that is free from bulkiness at the area of fixing to the natural hair, that avoids a sense of incongruity during wear over a long period of time, that is capable of being fitted securely over a long period of time, and that is free from adverse influence on the hair skin and roots of the hair, and a method of fitting a wig.

Another object of the invention is to provide a wig-fitting component wherein a wig may be fitted more securely than with a conventional fixing component, removal of the wig can be performed easily and in a short time, the area of removal is small, and the wig can be fixed without causing any damage, deformation and discoloration to the wig base.

A wig-fitting component according to the present invention includes a net-type or a net-like component or member at one side of a flexible planar component or member, with an adhesive adhered to opposite sides or surfaces of the planar component. A thread-like or thread-shaped member or members, for inserting and fastening natural hair of a wig-wearing person, may be provided on the net-type component.

A method of fixing a wig-fitting component to a wig base according to the present invention, wherein the wig-fitting component includes a net-type component struck to one side of a flexible planar component having adhesive adhered to opposite sides thereof, adhering the other adhesive to the wig base.

A method of fixing a wig according to the present invention, wherein a wig-fitting component includes a net-type component stuck on one side of a flexible planar component having adhesive adhered to opposite sides thereof includes adhering, the other adhesive side to the wig base, placing the wig on the head of a wig-wearing person, with the adhesive applied to the net-type component being in a non-solidified state to bind to natural hair, and subsequently solidifying the adhesive to fix the wig to the natural hair.

Furthermore, the wig-fitting component may include, on the net-type component, thread-shaped members for inserting and fastening the natural hair of a wig-wearing person. When the wig is placed on the head of the wig-wearing person, then the natural hair around the surrounding rim part of the wig base is inserted between the thread-shaped members and the net-type component, fastened to the thread-shaped members, folded and drawn to the outside of the surrounding rim part of the wig base, and subsequently an adhesive is applied onto the area where the natural hair inserted and fastened and solidified to fix the wig to the natural hair.

BRIEF DESCRIPTION OF THE DRAWINGS

FIG. 1(*b*) is an enlarged cross-sectional view taken along lines 1(*b*)—1(*b*) in FIG. 1(*a*);

FIG. 3(*b*) is an enlarged cross-sectional view taken along lines 3(*b*)—3(*b*) in FIG. 3(*a*);

FIG. 3(*c*) is an enlarged cross-sectional view taken along lines 3(*c*)—3(*c*) in FIG. 3(*a*);

DESCRIPTION OF THE PREFERRED EMBODIMENTS

Figure 1A:
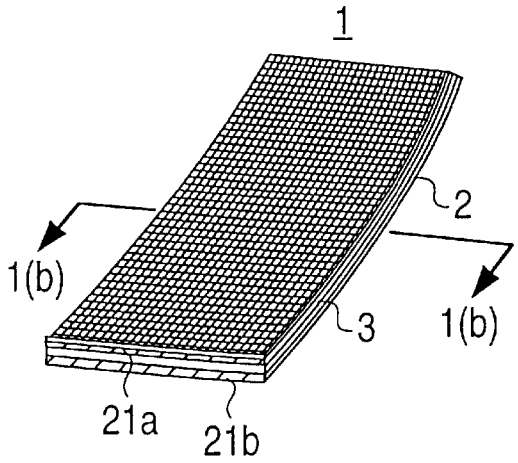
FIG. 1(*a*) is perspective view of a wig-fitting component.
Figure 1B:
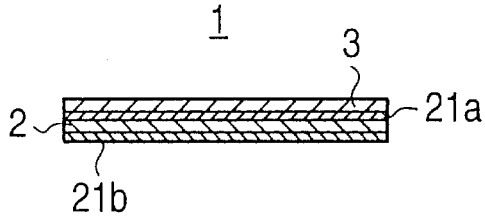

In FIGS. 1(*a*)–1(*b*), a wig-fitting component or element 1 comprises a net-type or net-shaped component 3 stuck on one side of a flexible planar component 2 with adhesive 21*a*, 21*b* adhered to opposite sides of component 2. That is, the wig-fitting component 1 is, as shown in FIG. 1(*b*), a laminated component comprising four layers: namely a layer of the adhesive 21*b*, a layer of the flexible planar component 2, a layer of the adhesive 21*a*, and a layer of the net-type component 3.

The flexible planar component 2 is a component with a small thickness as compared with a length and a width thereof, and preferred materials thereof include those comprising transparent or semitransparent synthesized resins such as plastics, for example, polyethylene, polypropylene and vinyl chloride, formed into flexible ultrathin films or thin sheets. Onto both front and back sides or surfaces flexible planar component 2 are adhered an adhesive comprising a resin such as an acrylic resin or rubber as a main agent to provide the layer of the adhesive 21*a* and the layer of the adhesive 21*b*.

Figure 2:
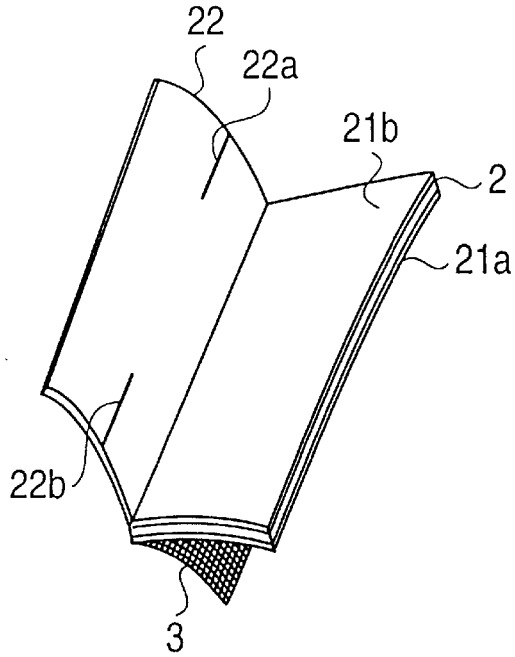
FIG. 2 is a perspective view of the wig-fitting component according to the present invention.

As shown in FIG. 2, it is preferable that, before the use of wig-fitting component 1, a film-like or sheet-like protective component or backing layer 22 is stuck on the outer side of the layer of the adhesive 21*b* as the outermost layer to prevent the removal of the adhesive and the adhesion of dirt and dust. In this case, the wig-fitting component 1 is a laminated component comprising five layers: namely a layer of the protective component 22, a layer of the adhesive 21*b*, a layer of the flexible planar component 2, a layer of the adhesive 21*a* and a layer of the net-like component 3. Such a protective component 22 is preferably a plastic film or sheet which can be released easily from the layer of the adhesive 21*b* when the wig-fitting component is used, and in particular, polypropylene or polyethylene films or sheets are preferred. In addition, as shown in FIG. 2, with a view to allowing the wig-fitting component 1 to be released easily during the use thereof to improve workability, it is preferable to provide straight-line notches 22*a* and 22*b* in the protective component 22.

As the net-type component 3, various mesh patterns such as lattice, honeycomb (hexagonal) and complicated lace patterns can be employed. For the mesh size, a net with tiny meshes is preferred from the viewpoints of the feeling of the net touching the skin of the head and improvement of adhesion of an adhesive to natural hair after the net is tangled with the adhesive well. Specifically, mesh sizes of from 70 to 120 per $cm^2$ are preferably employed. In particular, a mesh size of about 90 $cm^2$ and a thread diameter of from 30 to 50 deniers are preferred, lest the net-type component should become thick.

Net-type component 3 is thin, and hence, when it is stuck on the flexible planar component 2, the adhesive 21*a* comes to the surface of the net-type component 3 through the meshes thereof Hence, when natural hair comes into contact with the surface of net-like component 3, the natural hair is tangled by the adhesive 21*a* and easily becomes adhered thereto. Thus, work ability in fitting the wig to the natural hair is easy. Either surface of net-type component 3 can be stuck and fixed to the flexible planar component 2 by means of the adhesive 21*a*. Further, components 2, 3 also can be sewed so that they are fixed more firmly.

The wig-fitting component 1 can be fixed to a back of a base of a wig. Component 1 may be formed into a continuous tape-like form over the entire circumference of the back of the wig base, or it may be formed into a plurality of small pieces that can be fixed to the back of the wig base in a row.

When the flexible planar component 2 or the net-like component 3 is formed and processed, a color matching the natural color of the head skin or the color of the hair may be added lest it should be conspicuous from the outside.

Figure 3A:
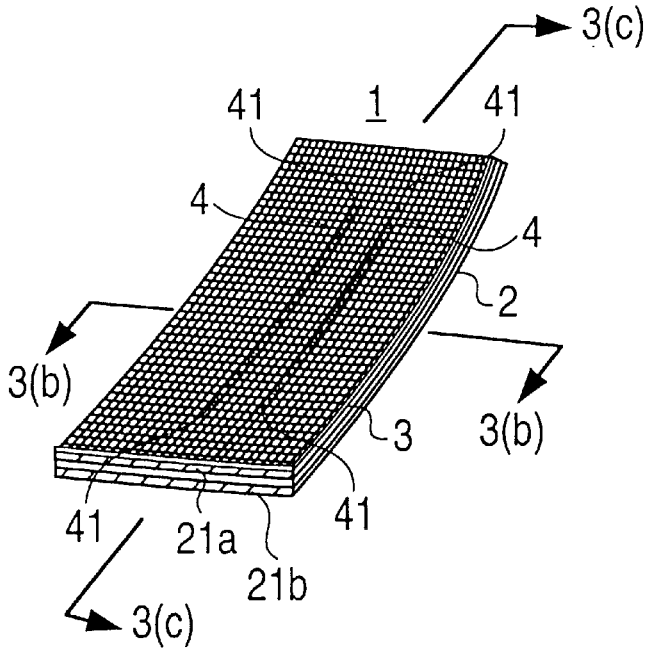
FIG. 3(*a*) is a perspective view of a wig-fitting component according to the present invention.
Figure 3B:
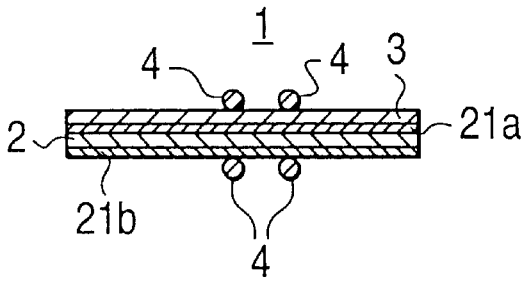
Figure 3C:
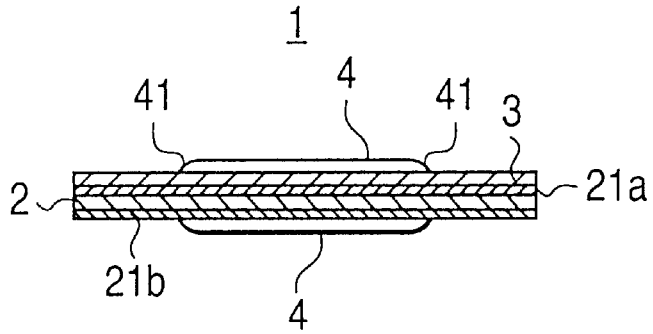

FIGS. 3(*a*)–4 show another embodiment of a wig-fitting component according to the present invention.

This embodiment includes the wig-fitting component 1 of the above embodiment with thread-shaped members 4 for inserting and fastening the natural hair of the user additionally provided on the net-type component 3. Hence, this embodiment is the same as the above embodiment, except that the thread-shaped members 4 additionally are provided. Thus, the wig-fitting component 1 comprises the net-type component 3 stuck on one side of the flexible planar component 2 with adhesive 21*a*, 21*b* adhered to opposite sides of component 2. That is, the wig-fitting component 1 is a laminated component comprising four layers, namely: a layer of the adhesive 21*b*, a layer of the flexible planar component 2, a layer of the adhesive 21*a*, and a layer of the net-type component 3 with the thread-shaped members 4 provided thereon. The same materials as in the above embodiment are employed for the flexible planar component 2, the adhesive 21*a*, 21*b* and the net-type component 3 as constituent components.

Figure 4:
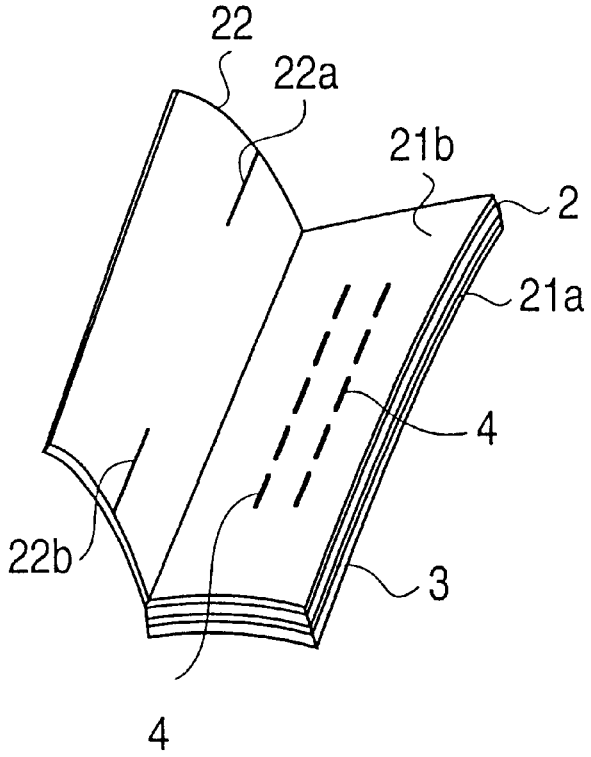
FIG. 4 is a perspective view of the wig-fitting component according to the present invention.

As shown in FIG. 4, it is preferable in this embodiment also that, before the use of wig-fitting component 1, a film-type or sheet-type protective component 22 is stuck on the outside of the layer of the adhesive 21*b* as an outermost layer to prevent the removal of the adhesive and the adhesion of dirt and dust. In this case, the wig-fitting component 1 is a laminated component comprising five layers, namely: a layer of the protective component 22, a layer of the adhesive 21*b*, a layer of the flexible planar component 2, a layer of the adhesive 21*a* and a layer of the net-type component 3. Such a protective component 22 is preferably a plastic film or sheet which can be released easily from the layer of the adhesive 21*b* when the wig-fitting component is used, and in particular, polypropylene or polyethylene films or sheets are preferred. In addition, as shown in FIG. 4, with a view to allowing the wig-fitting component 1 to be released easily during the use thereof to improve work ability, it is preferable to provide straight-line notches 22*a* and 22*b* in the protective component 22.

The thread-shaped members 4 comprise a vegetable fiber such as cotton and hemp, a synthetic fiber such as nylon, polyurethane and polyester, an animal fiber such as twisted wool, a fiber only bundled, or a thick single fiber. Ends 41 of members 4 are fitted on the net-type component 3, but the middle parts thereof are not fixed so that the natural hair of the user can be freely inserted and fastened.

As a method of providing the thread-shaped members 4 on the net-type component 3, as shown in FIG. 3(*c*), opposite ends 41 of individual long threads are passed through the adhesive 21*b* side of the fixing component 1 and tied thereat. In the illustrated arrangement, opposite ends 41 of members 4 are fixed to the net-type component 3. However, fixing may be provided at a middle portion other than ends 41, as long as there is provided a free portion for inserting and fastening the natural hair. One or more than two thread-shaped members 4 are provided on the net-type component 3. Since members 4 used for inserting and fastening the natural hair when the wig is fixed onto the head of a user and is fixed with a hair, a plurality of members 4 preferably are provided for performing fastening and the application of the adhesive easily. In FIGS. 3(*a*)–4, two thread-shaped members 4 are provided almost in parallel; however, they may be bundled as a twisted yarn.

A method of fixing the wig-fitting component according to the present invention described above to a wig base is described below.

Figure 5:
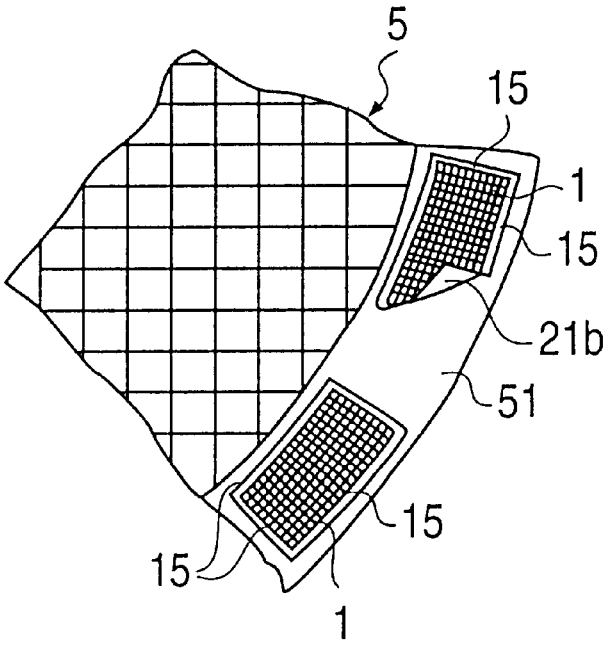
FIG. 5 is a plan view showing a part of a back of a wig base.

FIG. 5 is a plan view showing apart of the back of one example of a wig base. That is, in FIG. 5, a central part of a wig is a net and a surrounding rim part has a flexible sheet-type wig base. This wig-fitting component according to the present invention is not restricted to a wig base with such a shape, but a flexible sheet-type wig base wholly formed of polyurethane or unwoven fabric or a wig base wholly formed of a net or a combination thereof can be employed. In FIG. 5 fitting components 1 are fitted to the surrounding rim part of the wig base. However, if the wig-fitting component 1 has no thread-shaped member provided on the net-type component, it may be fixed to the central part instead of the surrounding rim part.

In FIG. 5, first of all, the protective component 22 (not shown) protecting the surface of adhesive 21*b* on the opposite side of the surface with the net-type component 3 of the wig-fitting component 1 is released, and the wig-fitting component 1 is fixed to the surrounding rim part 51 of the back of the wig base 5. That is, component 1 is fixed so that the net-type component 3 is exposed. The fitting component 1 is stuck easily on the surrounding rim part 51 of the back of the wig base 5 by the adhesive 21*b*.

Next, the wig-fitting component 1 is sewed and sealed on the surrounding rim part 51 of the back of the wig base 5 by an adhesive. It is preferable to seal component 1 at boundary edges or parts 15 with the surrounding rim part 51 from the viewpoint of prevention of damage to the wig base. This sealing can be achieved by applying an adhesive onto the boundary parts 15, and, in the case of the wig base being made of a resin, applying a resin solution obtainable by dissolving the resin in a solvent and volatilizing the solvent to solidify. The wig-fitting component 1 is stuck by an adhesive. Only the narrow boundary parts with the wig base need be coated with the adhesive or the resin solution. Hence, dissolution of or damage to the wig base by the adhesive and the resin solution can be reduced to a minimum. In the case that the wig-fitting component 1 has thread-shaped members 4 provided on the net-type component 3, it is preferable that the thread-shaped members 4 extend almost parallel to the surrounding rim of the wig base, with a view to insertion and fastening, the natural hair. Generally, the surrounding rim part 51, which is a head contact surface of the back of the wig base 5, is formed of an artificial skin with polyurethane as a base. Thus, a preferred resin solution to be used for sticking the wig-fitting component 1 on the wig base 5, when the surrounding rim part 51 of the wig base 5 is formed of polyurethane, is a solution obtainable by dissolving polyurethane into a mixed solution (solvent) of dimethylformamide (DMF) and methyl ethyl ketone (MEK). When the wig-fitting component 1 is a small piece, the number of the wig-fitting components 1 to be fitted to the back of the wig base 5 is properly determined according to the size of the wig base 5.

The method of fitting the wig with the wig-fitting component 1 fixed to the back of the wig base 5 to the head is discussed below.

Figure 6A:
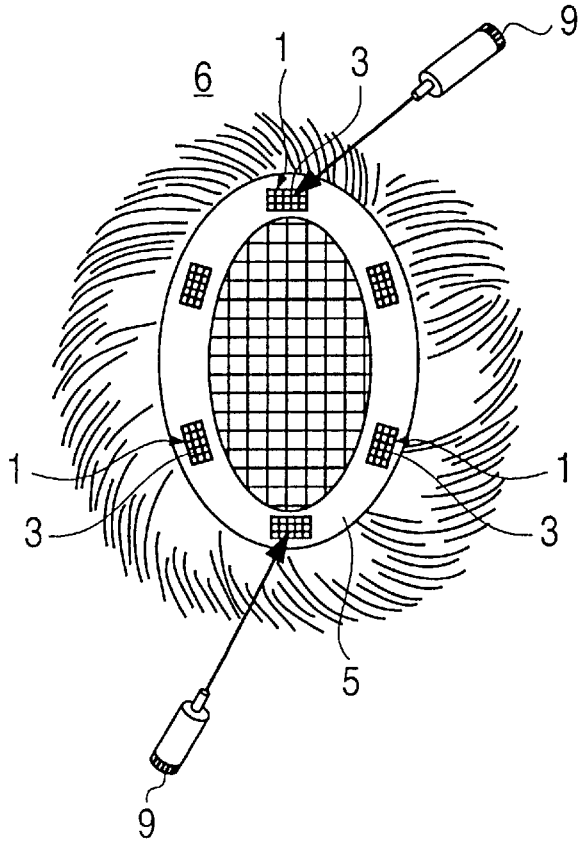
FIGS. 6(*a*) and 6(*b*) are schematic views showing the fixing of a wig to a head of a user.
Figure 6B:
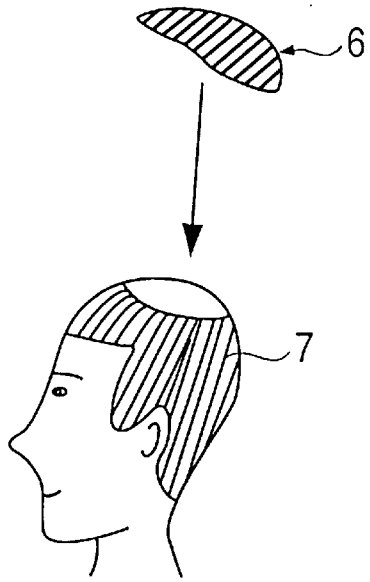

(i) When the wig-fitting component has no thread-shaped members for inserting and fastening the natural hair to the net-like component, then: FIGS. 6(*a*) and 6(*b*) are schematic views showing the fitting a wig to the head employing such wig-fitting component. As shown in FIG. 6(*a*), an external hair adhesive 9 is applied onto the net-type component 3 of the wig-fitting component 1 fixed to the back of a wig base 5. For the adhesive 9, latex-based, silicone-based, epoxy-based and polyurethane-based hair adhesives are employed; of them, latex-based aqueous emulsions are preferred. Subsequently, as shown in FIG. 6(*b*), with the adhesive 9 being in a non-solidified state, preferably in a semisolidified state, the wig 6 is put on the head of a user to fix the adhesive 9 to the natural hair 7, then the adhesive 9 is solidified completely or almost completely to fix the wig 6. The adhesive 9 spreads to every corner of the natural hair and the fine meshes of the net-type component 3, and in particular, enters such meshes. Hence, strong adhesion effects can be obtained by a so-called anchor action as compared with the case of employing a component with a smooth surface.

Figure 7A:
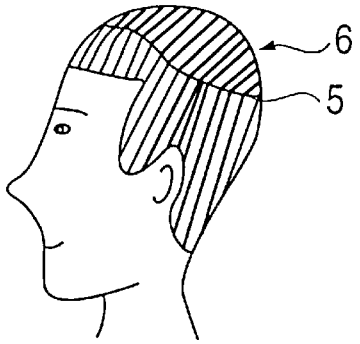
FIGS. 7(*a*)–7(*c*) are schematic views showing the fixing of a wig to the head of a user.
Figure 7B:
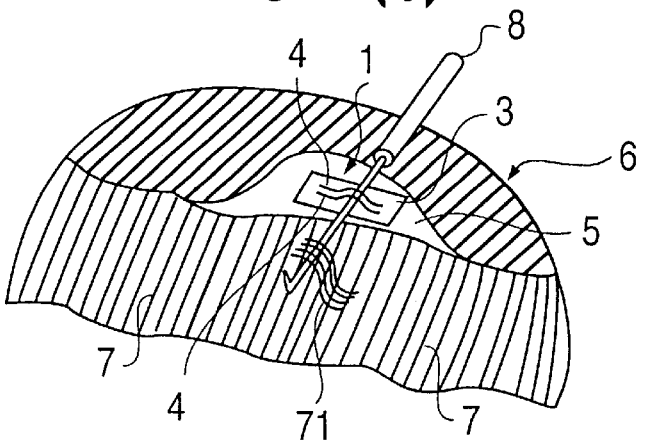
Figure 7C:
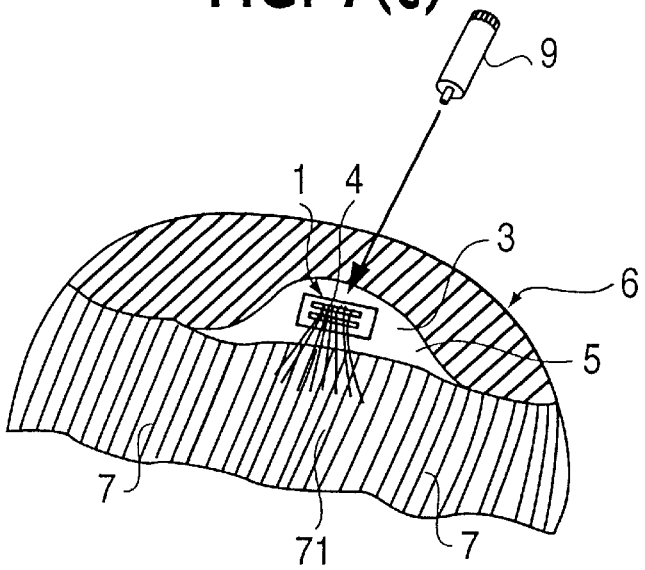
Figure 8:
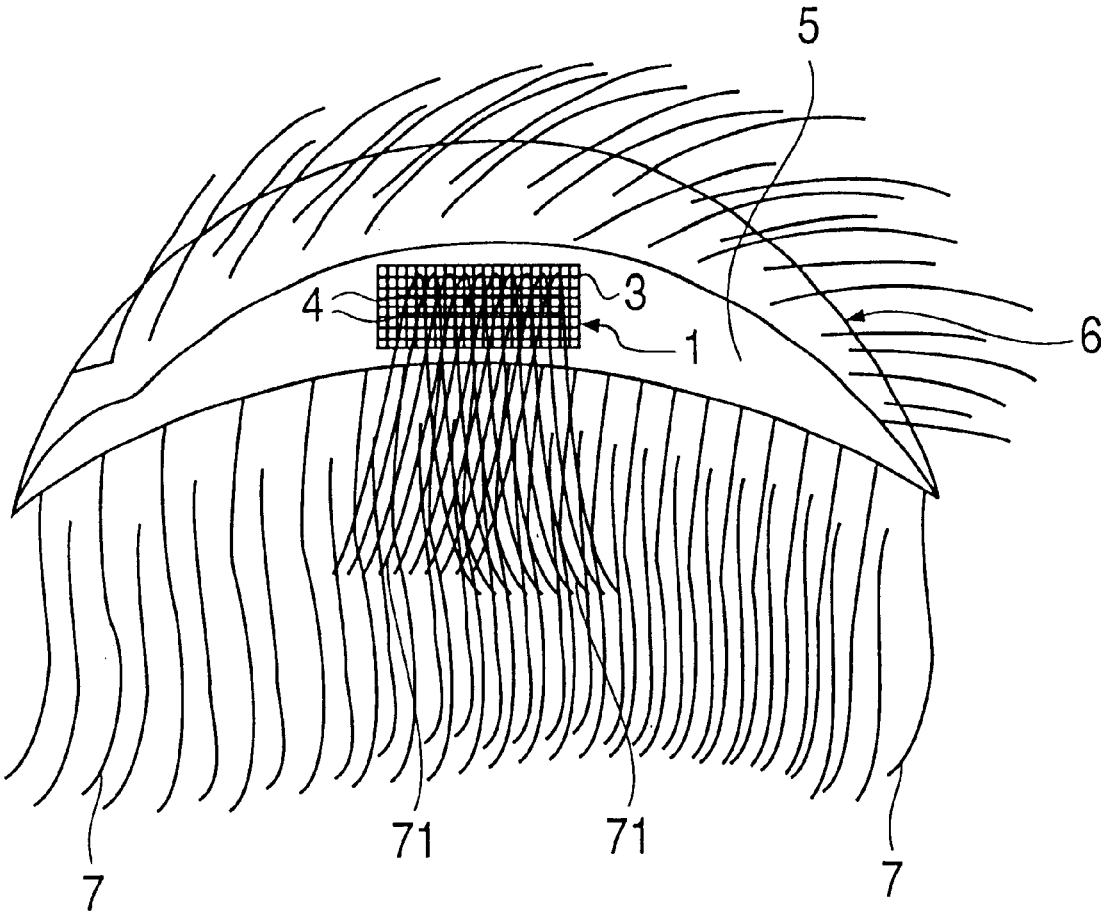
FIG. 8 is a partially enlarged view of an area for inserting and fastening natural hair shown in FIG. 7(*c*).

(ii) When the wig-fitting component has thread-shaped members for inserting and fastening the natural hair to the net-type component, then: FIGS. 7(*a*)–7(*c*) are schematic views showing the fixing a wig to the head employing such wig-fitting component. FIG. 8 is a partially enlarged view of an area where the natural hair is inserted and fastened as shown in FIG. 7(*c*). As shown in FIG. 7(*a*), first of all, the wig 6 is put on the head of a wig-wearing person. Subsequently, as shown in FIG. 7(*b*), an operating rod 8 with a hook on the tip is inserted between the net-type component 3 and the thread-shaped members 4 to hook the natural hair near the surrounding rim part of the wig base 5, preferably the natural hair 71 at the outside of the surrounding rim part of the wig base 5. Then the hook is pulled up on the net-type component 3 to insert the natural hair between the net-type component 3 and the thread-shaped members 4. The adhesive at the underside of the net-type component 3 passes to the upper surface thereof. Thereby, the natural hair (7 or 71) easily adheres to the net-type component 3. Next, as shown in FIG. 7(*c*), the inserted natural hair is fastened to the thread-shaped members 4 and folded, and then drawn again to the outside of the surrounding rim part of the wig base 5. Then the adhesive 9 is applied onto the area where the natural hair is inserted and fastened, namely, the area where the net-type component 3, the thread-shaped members 4 and the natural hair (7 or 71) meet, and solidified, thus to fix the wig. The adhesive 9 applied onto the area where the natural hair is inserted and fastened spreads to every corner of the natural hair (7 or 71), the thread-shaped members 4 and the fine meshes of the net-type component 3, and in particular, enters such meshes. Hence, a stronger adhesion effect can be obtained by a so-called anchor action, compared with the case of employing a component with a smooth surface. The adhesive 9 can be latex-based, silicone-based, epoxy-based and polyurethane-based hair adhesives; of them, latex-based aqueous emulsions are preferred.

As shown in FIG. 8, it is preferable that only the natural hair 71 at the outside of the surrounding rim part of the natural hair 7 around the surrounding rim part of the wig base 5 is pulled up on the net-type component 3 and used for fixing the wig 6. That is, the natural hair 7 grows downward (in a direction from the crown of the head toward the side of the head). Hence, if only the natural hair 71 at the outside of the surrounding rim part is pulled up to fasten to the thread-shaped members 4, folded in a downward direction as the natural hair grows, and drawn to the outside of the surrounding rim part of the wig, the wig can be prevented from coming off without going against the direction of growth of the natural hair.

The effects of the present invention include the following.

(1) The wig-fitting component according to the present invention is composed of a thin flexible planar component and a thin net-type component; the area for a wig to be attached to the natural hair and fitted to the head is not bulky, and no sense of incongruity occurs in the use thereof over a long period of time.

(2) The wig-fitting component according to the present invention can be fixed securely for a long period of time, since the natural hair is stuck by an adhesive to fix a wig. In addition, if thread-shaped members for inserting and fastening the natural hair are provided additionally, the wig-fitting component can be fixed more firmly.

(3) The side of the wig-fitting component according to the present invention for sticking the natural hair by an adhesive is formed of a net-like component. Hence, the adhesive spreads to every corner of the natural hair (and the thread-shaped members) and the fine meshes of the net-type component, and in particular, enters such meshes. Hence, a stronger adhesion effect can be obtained by a so-called anchor action as compared with the case of employing a component with a smooth surface. Moreover, if a fine-mesh and thin component is employed as the net-type component, the feeling of contact with the head skin is excellent. Furthermore, the adhesion of a wig is reinforced as compared with the case of a conventional fixing component, it can be removed from the head easily and in a short time, and the removal area is small.

(4) When the wig-fitting component according to the present invention is stuck on the natural hair by an adhesive to fix a wig, the adhesive does not spread outside the surface of the net-type component. Hence, there exists no fear of influence of the adhesive on the head skin and roots of the hair.

(5) In the wig-fitting component according to the present invention, since the underside of the net-type component for the natural hair to adhere thereto is an adhesive layer, the adhesive passes to the outer surface of the net-type component, and thereby the natural hair is easily adhered; hence, the operation of fitting the wig becomes easier.

(6) According to the method of fitting the wig of the present invention, the wig-fitting component according to the present invention is employed; hence, as described above, the feeling of the wearer is excellent and the wig-fitting component does not come off even if it is worn over a long period of time since it is fixed firmly. Moreover, it possible to wash the hair as the wig is worn. In addition, if only the natural hair at the outside of the surrounding rim part of the natural hair around the surrounding rim part of the wig base is pulled up on the wig-fitting component to be fixed, then folded in a downward direction as the natural hair grows and drawn to the outside of the surrounding rim part of the wig, the wig can be prevented from coming off.

(7) The method of fitting the wig-fitting component according to the present invention to the wig base employs a flexible planar component with the wig-fitting component according to the present invention coated with an adhesive. Hence, the wig-fitting component has to be fixed only at the boundary part with the wig base, and thereby damage, deformation and discoloration of the wig base by the adhesive can be reduced to minimum.

What is claimed is:

1. An element to be employed for fixing a wig to a head of a wearer, said element comprising:

a flexible planar component;

adhesive applied to opposite first and second sides of said flexible planar component; and a net-type component stuck on said adhesive on said first side of said flexible planar component.

2. An element as claimed in claim 1, further comprising at least one thread-shaped member attached to said net-type component, such that hair of the user may be inserted between said at least one thread-shaped member and said net-type component.

3. An element as claimed in claim 2, comprising plural thread-shaped members attached to said net-type component.

4. An element as claimed in claim 1, further comprising a backing layer on said adhesive on said second side of said flexible planar component.

5. A method of fixing a wig to the head of a wearer, said method comprising:

adhering to a base of said wig an element including:

a flexible planar component, adhesive applied to opposite first and second sides of said flexible planar component, and a net-type component stuck on said adhesive on said first side of said flexible planar component, with said adhesive on said first side of said flexible planar component passing through meshes of said net-type component to an outer surface thereof by sticking said adhesive on said second side of said flexible planar component to said wig base;

temporarily attaching said wig to hair of the wearer by adhering to said hair said adhesive on said first side of said flexible planar component that has passed through said meshes of said net-type component to said outer surface thereof;

applying external adhesive to said net-type component; and solidifying said adhesive and said external adhesive to fix said wig to said hair of the wearer.

6. A method as claimed in claim 5, wherein said external adhesive spreads into said meshes of said net-type component and all around said hair to which said wig is temporarily attached.

7. A method of fixing a wig to the head of a wearer, said method comprising:

adhering to a base of said wig an element including:

a flexible planar component, adhesive applied to opposite first and second sides of said flexible planar component, a net-type component stuck on said adhesive on said first side of said flexible planar component, and at least one thread-shaped member attached to said net-type component by sticking said adhesive on said second side of said flexible planar component to said wig base;

positioning said wig on the head of the wearer with said net-type component on the head of the wearer;

inserting hair of the wearer from an area surrounding an edge of said wig between said at least one thread-shaped member and said net-type component, folding said hair over said at least one thread-shaped member, and extending the thus folded hair beyond said edge of said wig;

applying external adhesive to the hair at the area of folding thereof and to said net-type component; and solidifying said external adhesive to fix said wig to said hair of the wearer.

8. A method as claimed in claim 7, wherein said adhesive on said first side of said flexible planar component passes through meshes of said net-type component to an outer surface thereof, and wherein said positioning temporarily attaches said wig to hair of the wearer by adhering to said hair said adhesive on said first side of said flexible planar component that has passed through said meshes of said net-type component.

9. A method as claimed in claim 7, wherein said external adhesive spreads into said meshes of said net-type component and all around said at least one thread-shaped member and said folded hair at the area thereof that is folded over said at least one thread-shaped member.

* * * * *